US010553935B2

(12) United States Patent
Su et al.

(10) Patent No.: US 10,553,935 B2
(45) Date of Patent: Feb. 4, 2020

(54) PLANAR RF ANTENNA WITH DUPLICATE UNIT CELLS

(71) Applicant: Google LLC, Mountain View, CA (US)

(72) Inventors: Wenjing Su, Mountain View, CA (US); Jiang Zhu, Cupertino, CA (US); Huan Liao, San Jose, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/820,610

(22) Filed: Nov. 22, 2017

(65) Prior Publication Data

US 2019/0157747 A1 May 23, 2019

(51) Int. Cl.

| | |
|---|---|
| ***H01Q 3/36*** | (2006.01) |
| ***H01Q 1/27*** | (2006.01) |
| ***H01Q 1/48*** | (2006.01) |
| ***H01Q 1/22*** | (2006.01) |
| ***H01Q 21/06*** | (2006.01) |
| ***H01Q 7/00*** | (2006.01) |

(52) U.S. Cl.

CPC ..... *H01Q 1/273* (2013.01); *H01Q 1/2258* (2013.01); *H01Q 1/48* (2013.01); *H01Q 7/00* (2013.01); *H01Q 21/061* (2013.01)

(58) Field of Classification Search

CPC ..... H01Q 1/273; H01Q 1/2258; H01Q 1/48; H01Q 21/061

USPC ..... 343/720, 729, 702, 700 MS

See application file for complete search history.

(56) References Cited

U.S. PATENT DOCUMENTS

| | | | | |
|---|---|---|---|---|
| 4,243,993 | A * | 1/1981 | Lamberty | H01Q 11/083 343/895 |
| 7,911,386 | B1 | 3/2011 | Itoh et al. | |
| 9,478,852 | B2 | 10/2016 | Werner et al. | |
| 9,746,984 | B2 | 8/2017 | Stafford | |
| 2003/0048234 | A1* | 3/2003 | Alexopoulos | H01P 1/2005 343/895 |
| 2003/0137457 | A1 | 7/2003 | McKinzie, III et al. | |
| 2003/0184476 | A1* | 10/2003 | Sikina | H01Q 3/36 343/700 MS |

(Continued)

FOREIGN PATENT DOCUMENTS

CN 103490160 B 9/2015

OTHER PUBLICATIONS

Peter Vanveerdeghem, et al., "Synchronous Wearable Wireless Body Sensor Network Composed of Autonomous Textile Nodes," Sensors, Oct. 9, 2014, 28 pages.

(Continued)

*Primary Examiner* — Peguy Jean Pierre

(57) ABSTRACT

An antenna includes a planar dielectric substrate having opposing first and second surfaces, a ground plane disposed at the first surface, the ground plane composed of conductive material, a radiating plane disposed at the second surface and composed of conductive material. The radiating plane implements a plurality of unit cells, with each unit cell having a corresponding section of the conductive material of the radiating plane that is formed in a specified shape, the specified shape including a first portion forming a load inductor and second portion forming a radiating patch electrically coupled to the load inductor. Each unit cell further includes at least one via electrically coupling the load inductor to the ground plane.

23 Claims, 10 Drawing Sheets

(56) References Cited

U.S. PATENT DOCUMENTS

| | | | | |
|---|---|---|---|---|
| 2006/0022882 | A1* | 2/2006 | Gerder | H01Q 1/273 343/718 |
| 2011/0170267 | A1* | 7/2011 | Ando | H01Q 9/30 361/748 |
| 2012/0256807 | A1* | 10/2012 | Ma | H01Q 1/243 343/860 |
| 2016/0036118 | A1* | 2/2016 | Baringer | H01Q 21/28 343/702 |
| 2016/0118720 | A1* | 4/2016 | Kim | H01Q 1/3275 343/700 MS |
| 2018/0074582 | A1* | 3/2018 | Mahon | G06F 3/013 |

OTHER PUBLICATIONS

Douglas H. Werner, et al., "A Compact, Low-Profile Metasurface-Enabled Antenna for Wearable Medical Body-Area Network Devices," in IEEE Transactions on Antennas and Propagation, vol. 62, No. 8, Aug. 2014, 10 pages.

Saddi Blumrosen and Ami Luttwak, "Human Body Part Tracking and Kinematic Features Assessment Based on RSSI and Inertial Sensor Measurements," in Sensors, Aug. 23, 2013, 25 pages.

International Search Report and Written Opinion dated Nov. 13, 2018 for International Application No. PCT/US2018/046675, 13 pages.

English Translation of Taiwanese Office Action dated Oct. 1, 2019 for TW Application No. 107130454, 5 pages.

* cited by examiner

PLANAR RF ANTENNA WITH DUPLICATE UNIT CELLS

BACKGROUND

The human body presents particular challenges for wireless signaling between body-mountable devices (that is, "wearable" devices) employing radio frequency (RF) signaling. The human body has a high permittivity, which introduces a detuning effect that changes the operational frequency of an antenna in proximity to the body. Moreover, the human body also has a high conductivity, which introduces a high dielectric loss and, as a consequence, reduces the antenna's radiating efficiency. As such, the high permittivity and high conductivity of the human body makes it difficult for RF signals at microwave frequencies to penetrate the human body, and thus leading to a shadowing effect that limits cross-body communications. Moreover, wireless wearable devices often may be worn and used while the user is in a large room or outdoors, and thus the wearable devices cannot reliably depend on multipath reflection for cross-body communications.

In view of these complexities, wearable device designers frequently rely on surface waves (also known as creeping waves) to establish cross-body communications between wireless wearable devices. One conventional antenna that is effective at generating such surface waves is the monopole antenna. However, as a monopole antenna relies on a radiating structure that projects orthogonally from a ground plane for a considerable distance, monopole antennas typically have a form factor that is impracticable for use in portable devices intended to be worn by the user. Other conventional antenna designs that have been attempted for cross-body signaling include patch antennas, slot antennas, inverted-F antennas (IFAs), and dipole antennas. However, the signaling effectiveness of each of these antenna designs is orientation dependent relative to the shortest path to the other antenna along the body surface, and it typically is not reasonable to expect the antennas on two different wearable devices worn by a user to maintain a constant orientation for cross-body communications.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Disclosed herein are embodiments of an antenna that overcomes the body effect of the human body so as to provide more efficient and effective cross-body wireless communications, and a method for its use. In some embodiments, the antenna comprises a ground plane and a radiating plane disposed at opposing major surfaces of a dielectric substrate. The radiating plane forms a plurality of unit cells that are electrically interconnected. Each unit cell has the substantially same shape and same dimensions at the other unit cells, and includes a load inductor and a conductive radiating patch. The load inductor may be a discrete inductor electrically coupled to the radiating patch, or the load inductor may be formed as a pattern in the conductive material of the portion of the radiating patch corresponding to the unit cell. The load inductor is electrically coupled to the ground plane via one or more vias extending through the dielectric substrate. The radiating patch, in some embodiments, at least partially or fully encloses the load inductor. The unit cells may be disposed at the surface of the dielectric substrate in any of a variety of patterns, such as in an "X" shape, a "C" shape, a "H" shape, and the like.

As explained in greater detail herein, the electrically-coupled duplicate unit cell configuration of the antenna (hereinafter, "duplicate-cell antenna") results in substantially similar current distribution among the unit cells during operation, and thus the unit cells resonate substantially equally and in substantially the same phase. As such, the RF output of the unit cells is additive, and results in effective surface wave transmission, even in proximity to a human body with its high permittivity and high conductivity, and this surface wave generation is relatively independent of orientation. Moreover, because the form factor of the antenna is planar and relatively thin, and may be fabricated in relatively small dimensions for operation at microwave frequencies, the antenna is well-suited for implementation in body-mountable devices (i.e., "wearable devices") intended for cross-body communication with other body-mountable devices. Such devices include head-mounted display (HMD) devices, handheld controllers and other wireless components used in augmented reality (AR) or virtual reality (VR) systems, wireless earbuds or earpiece systems, and the like.

Figure 1:
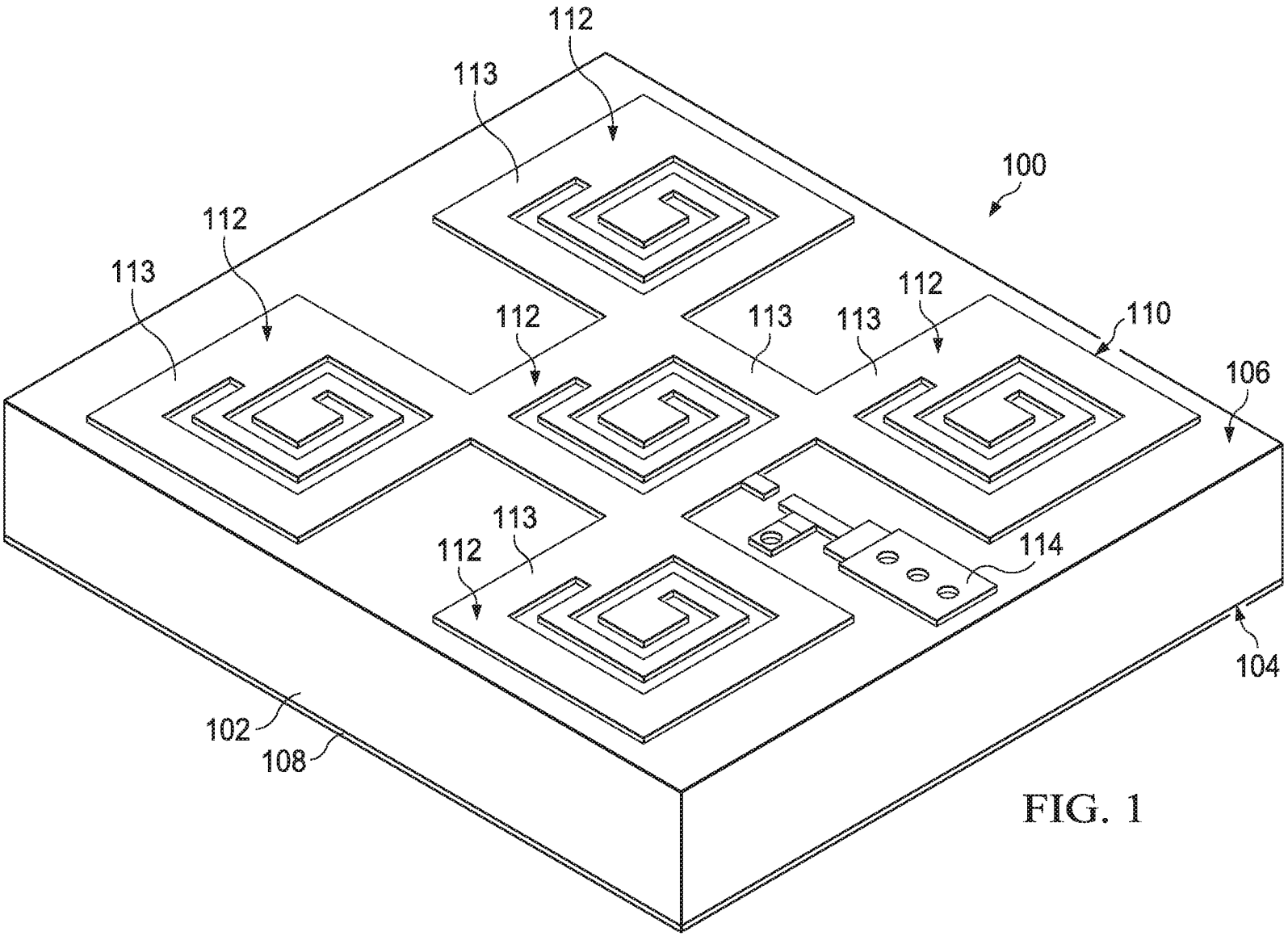
FIG. 1 is a perspective view of a duplicate-cell antenna in accordance with some embodiments.

FIG. 1 illustrates a perspective view of a duplicate-cell antenna 100 in accordance with some embodiments. The duplicate-cell antenna 100 includes a substantially planar dielectric substrate 102 having a first major surface 104 and an opposing second major surface 106. The dielectric substrate 102 is composed of any of a variety of suitable dielectric materials, or combinations thereof, such as glass-reinforced epoxy laminate (e.g., FR4), polytetrafluoroethylene (PTFE)(also known by its tradename "Teflon"™), PTFE and glass composite laminate (also known by its tradename "Duriod"™); polyimide film (also known by its tradename "Kapton"™); and liquid-crystal polymer (LCP). The dielectric substrate 102 may be rigid, such as when composed of the aforementioned FR4, or the dielectric substrate 102 may be implemented as a flexible substrate, such as when composed of the aforementioned Teflon. A conductive ground plane 108 is disposed at the major surface 104, and is composed of one or more conductive materials, such as metals (e.g., copper, gold), metal alloys, graphene, conductive polymers, and combinations thereof.

The duplicate-cell antenna 100 further includes radiating plane 110 disposed at the major surface 106. The radiating plane 110 is composed of one or more conductive materials 113 disposed, formed, shaped, or otherwise arranged in a particular pattern to implement the corresponding components (described below) at the major surface 106. The conductive material 113 may be the same conductive material implemented in the ground plane 108 or a different conductive material. To illustrate, in at least one embodiment, the duplicate-cell antenna 100 is formed using a printed circuit board (PCB) workpiece having a FR4 dielectric layer (one embodiment of the dielectric substrate 102) and two copper layers (one embodiment of the conductive material 113) on the opposing major surfaces, and whereby the ground plane 108 and the radiating plane 110 are formed by etching the corresponding patterns in the copper layers.

Figure 4:
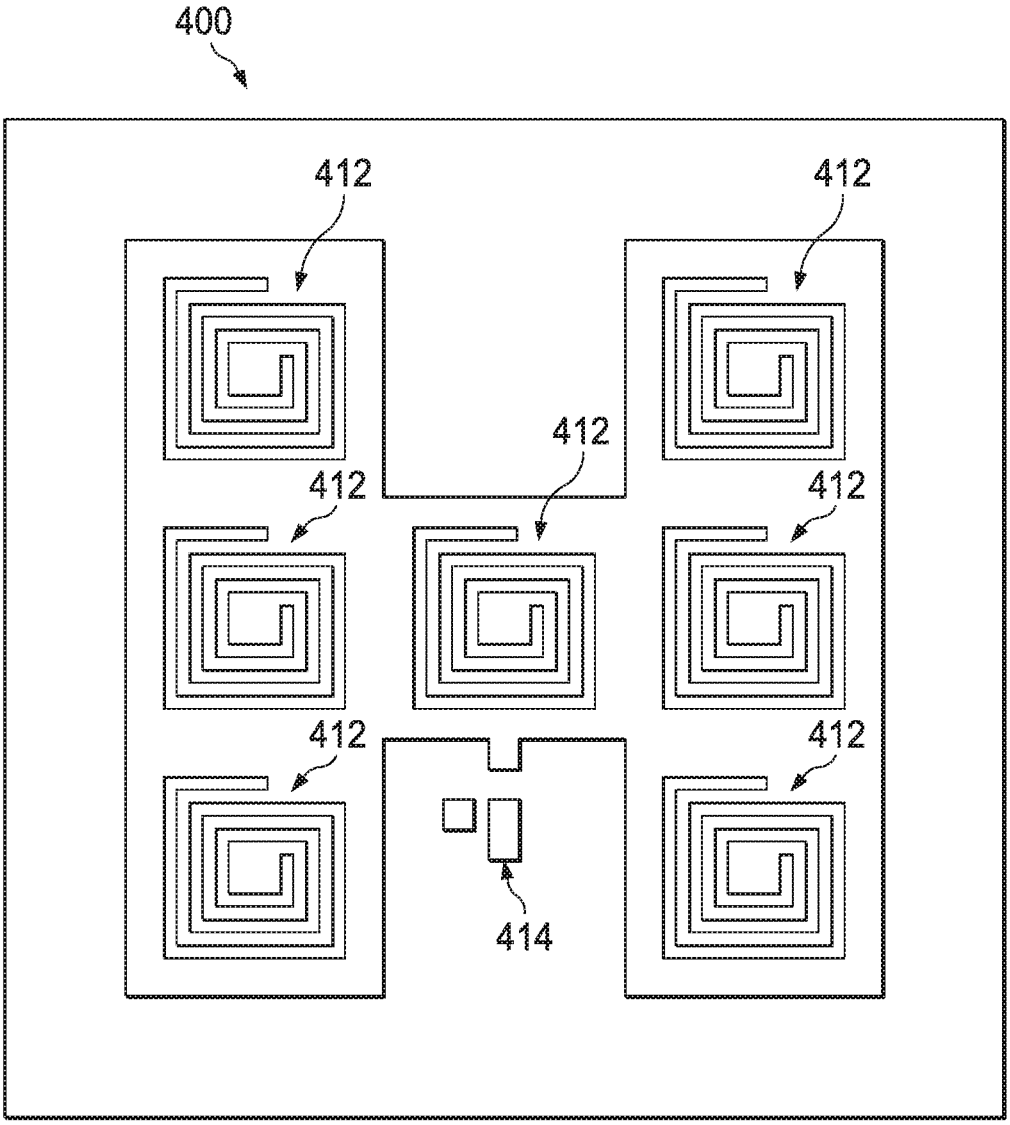
FIG. 4 is a top view of a duplicate-cell antenna having unit cells in an "H" pattern in accordance with some embodiments.
Figure 5:
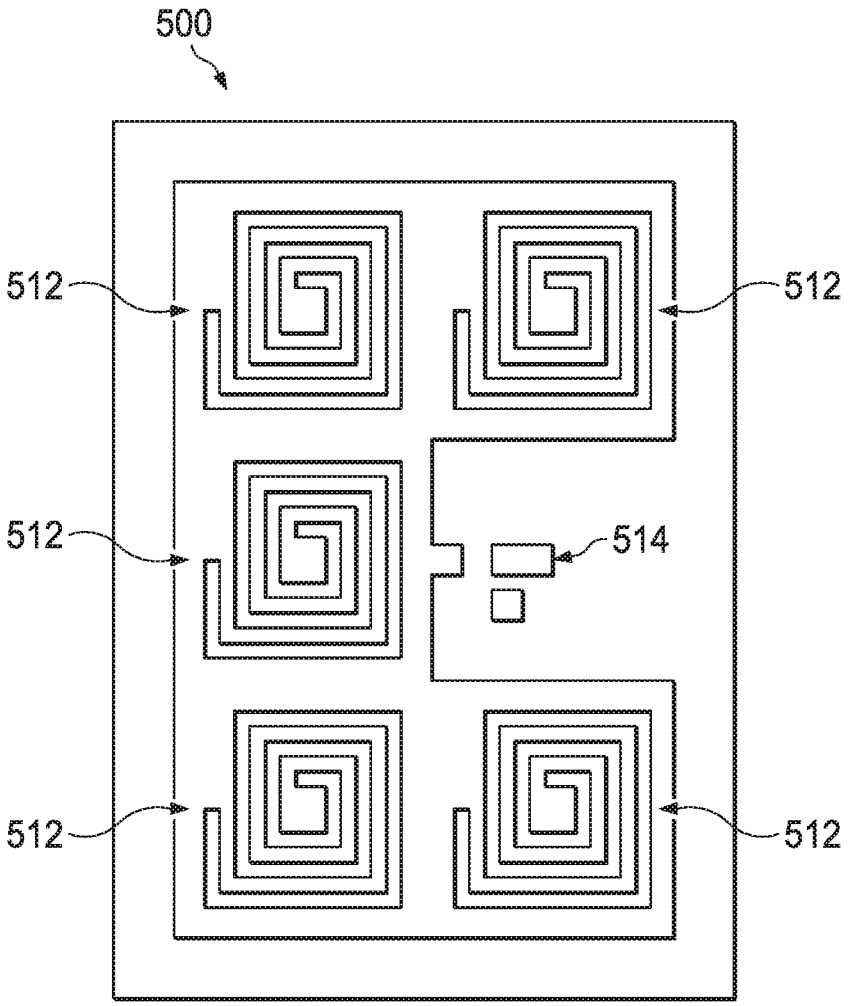
FIG. 5 is a top view of a duplicate-cell antenna having unit cells in a "C" pattern in accordance with some embodiments.

The radiating plane 110 is composed of a plurality of unit cells 112. Each unit cell 112 has substantially the same shape and dimensions (that is, the unit cells 112 are substantial duplicates of each other), and includes a radiating patch and a load inductor (formed either in the conductive material 113 of the unit cell 112 or by way of a discrete inductor coupled to the conductive material 113 of the unit cell 112). The plurality of unit cells 112 can be arranged in any of a variety of patterns such that each unit cell 112 is in electrical (that is direct physical contact) with at least one neighboring unit cell 112. In the example of FIG. 1, the duplicate-cell antenna 100 includes five unit cells 112 arranged in an "X" pattern, with one unit cell 112 serving as the center cell and the other four unit cells 112 extending out diagonally from the corners of the center unit cell 112. Turning briefly to FIGS. 4 and 5, other examples of the patterning of the unit cells 112 include the seven unit cells 112 arranged in an "H" shape as shown in FIG. 4 and the five unit cells 112 arranged in a "C" shape as shown in FIG. 5.

Returning to FIG. 1, the duplicate-cell antenna 100 further includes a feed/impedance matching network 114 to couple a feedline (not shown) to the radiating plane 110 via a discrete capacitor (not shown) or other coupling element, and to provide impedance matching via introduction of one or more discrete capacitors, discrete resistors, or discrete inductors, as is known in the art. One operational feature of the duplicate-cell antenna 100 is that the unit cells 112 can be operated to resonate substantially equally and substantially in phase, and thus have an additive radiation. To facilitate this effect, in at least one embodiment, the feed/impedance matching network 114 capacitively or directly couples the feedline to the most "centered" unit cell 112 in the pattern of unit cells so as to most effectively distribute equal current throughout the unit cells 112 of the radiating plane 110. Thus, in the example of FIG. 1, the feed/impedance matching network 114 feeds in to the unit cell 112 at the center of the "X" pattern of unit cells. However, in other embodiments, the feed point may not be relatively centered, although some asymmetry in the radiation pattern may result.

Figure 2:
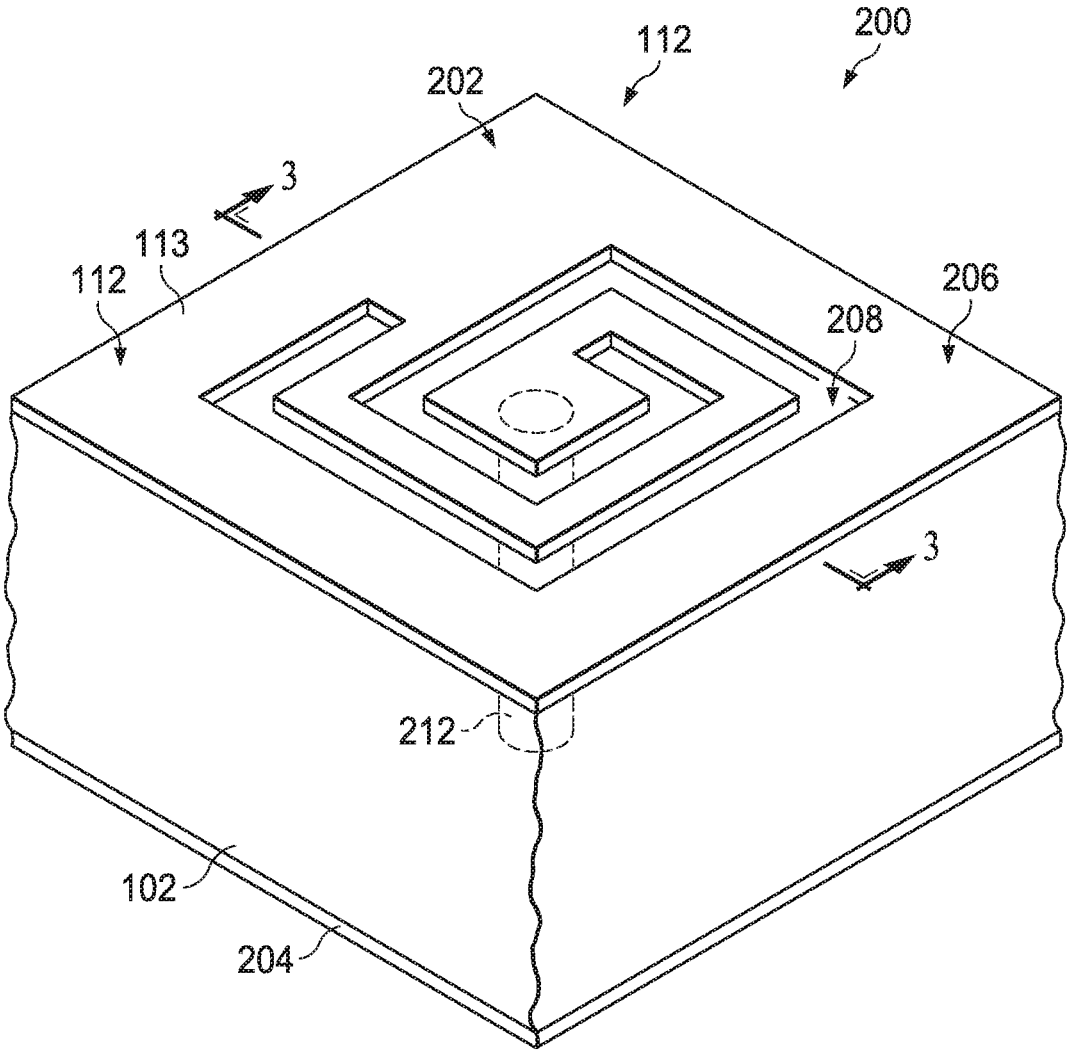
FIG. 2 is a perspective view of a single unit cell of the duplicate-cell antenna of FIG. 1 in accordance with some embodiments.
Figure 3:
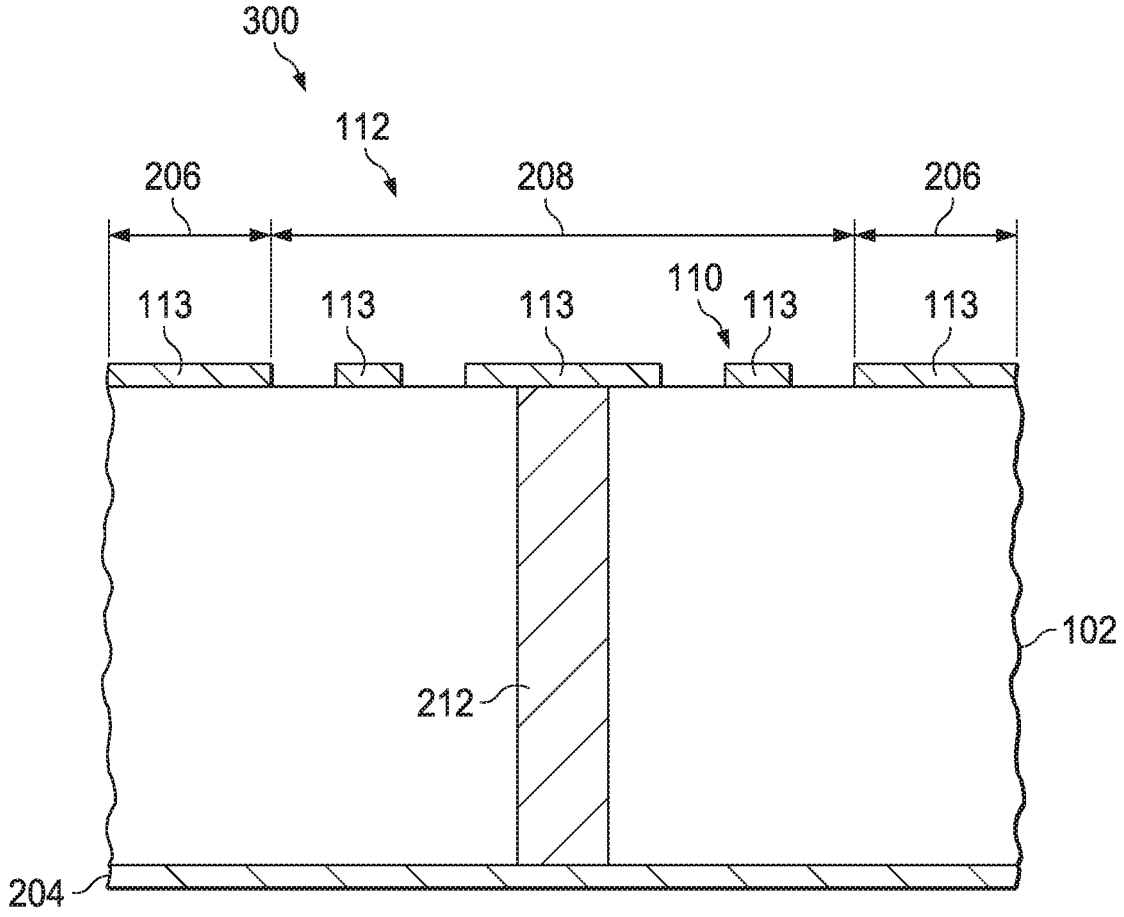
FIG. 3 is a cross-section view of the unit cell of FIG. 2 in accordance with some embodiments.

FIGS. 2 and 3 illustrate a perspective cross-section view 200 (FIG. 2) and a side cross-sectional view 300 (FIG. 3) of a single instance of a unit cell 112 in accordance with some embodiments. As shown, the unit cell 112 includes a corresponding section 202 of the conductive material 113 of the radiating plane 110 disposed on the opposite side of the dielectric substrate 102 from a corresponding section 204 of the ground plane 108. The conductive material 113 of the section 202 of the unit cell 112 is shaped or otherwise configured into two regions: a first region 206 forming a radiating patch (and thus region 206 is also referred to herein as "radiating patch 206") and a second region 208 that, in the embodiment of FIG. 2, is shaped to form a load inductor 210 electrically coupled to the radiating patch 206. In the depicted example, the conductive material 113 of the region 208 is shaped so as to create the load inductor 210 in the form of a square spiral shape. In other embodiments, the conductive material 113 of the region 208 forms the load inductor 210 in other shapes, such as a circular spiral shape, a hexagonal spiral shape, an octagonal spiral shape, meandering lines, a zig-zag pattern, and the like. In some embodiments, the radiating patch 206 has a specified external border shape (except where two unit cells 112 contact or interface), and this shape partially or fully encloses the load inductor 210. To illustrate, in the example of FIGS. 2 and 3, the radiating patch 206 has a square or otherwise rectangular external border and completely encircles or encloses the square spiral shape of the load inductor 210. In other embodiments, the radiating patch 206 may have, for example, a pentagonal external border shape, a hexagonal external border shape, an octagonal external border shape, and the like.

The unit cell 112 further includes one or more vias 212 extending from the conductive material 113 of the load inductor 210 to the section 204 of the ground plane 104, and thus conductively coupling the load inductor 210 to the ground plane 104. In some embodiments, the pattern of the conductive material 113 forming the load inductor 210 has two "ends", one end immediately adjacent to, and directly connected to, the conductive material 113 that forms the radiating patch 206, and a second end at the opposite end of the length of the pattern of the inductor 210. In such instances, the one or more vias 212 are coupled at or near this second end so as to maximize the effective inductance between the via and the first end of the load inductor 210. Alternatively, the position of the one or more vias 212 may be shifted away from this second end to a different position along the length of the inductor 210 so as to tune the inductance presented by the load inductor 210.

FIGS. 4 and 5 illustrate top views of alternative example embodiments of the duplicate-cell antenna 100. In particular, FIG. 4 illustrates a duplicate-cell antenna 400 (one embodiment of the duplicate-cell antenna 100) having seven unit cells 412 (one embodiment of the unit cell 112), each of the substantially same shape and dimensions, arranged in an "H" pattern such that three unit cells 412 form one electrically continuous column, another three unit cells 412 form another electrically continuous column, and the seventh unit cell 412 is disposed between the two columns and electrically couples the two columns. In this example, the seventh unit cell 412 between the two columns is the "center" unit cell 412 of this pattern, and thus the duplicate-cell antenna 400 includes a feed/impedance matching network 414 (one embodiment of the feed/impedance matching network 114) that couples a feedline to this center unit cell 412. FIG. 5 illustrates a duplicate-cell antenna 500 (another embodiment of the duplicate-cell antenna 100) having five unit cells 512 (one embodiment of the unit cell 112), each having the substantially same shape and dimensions, arranged in a "C" pattern such that two unit cells 512 form one electrically continuous row, another two unit cells 512 form another electrically continuous row, and the fifth unit cell 512 is disposed between the two rows and electrically couples the two row at their left end (from the perspective shown in FIG. 5). In this example, the fifth unit cell 512 between the two rows is the "center" unit cell 512 of this pattern, and thus the duplicate-cell antenna 500 includes a feed/impedance matching network 514 (one embodiment of the feed/impedance matching network 114) that couples a feedline to this center unit cell 512. Although FIGS. 1, 4, and 5 illustrate various embodiments of patterns in which the unit cells 112 may be arranged so as to form the radiating plane 110, the present disclosure is not limited to these example patterns, and instead may encompass any of a variety of patterns in accordance with the guidelines provided herein.

Figure 6:
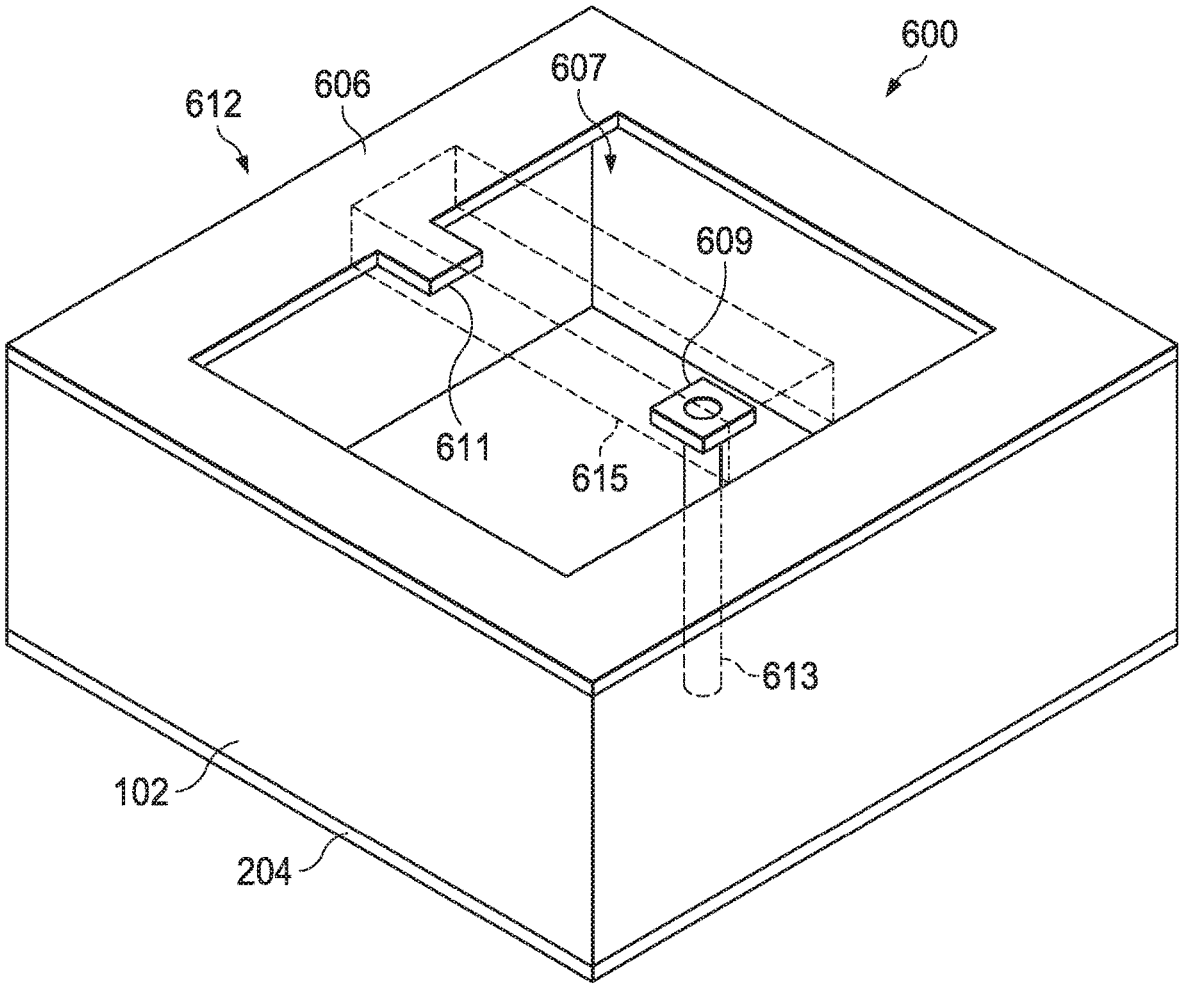
FIG. 6 is a perspective view of a duplicate-cell antenna with unit cells having discrete inductors in accordance with some embodiments.

FIG. 6 illustrates a cross-section perspective view of a discrete-inductance unit cell 612 in accordance with at least some embodiments. The discrete-inductance unit cell 612 is an alternative embodiment of the unit cell 112, in which rather than utilizing conductive material 113 of the unit cell to form a load inductor, the unit cell 612 instead utilizes a discrete inductor 602 mounted at the unit cell 612. In this embodiment, the unit cell 612 includes a radiating patch 606 formed at the surface of the dielectric substrate 102 that is opposite of the ground plane 108. The conductive material of the radiating patch 606 forms an opening 607 that is substantially devoid of conductive material, with the exception of a conductive pad 609 formed in the opening, but separate from the radiating patch 606. The conductive pad 609 is electrically coupled to the ground plane 108 using one or more vias 613 through the dielectric substrate 102. The radiating patch 2046 further may include a corresponding pad extension 611 at the periphery of the opening 607. A discrete inductor 615 then is mounted to the unit cell 612 using the pad 609 and pad extension 611 such that the discrete inductor 615 spans between the pad 609 and pad extension 611 and introduces a corresponding inductance between the ground plane 104 (FIG. 1) and the radiating patch 606.

Figure 7:
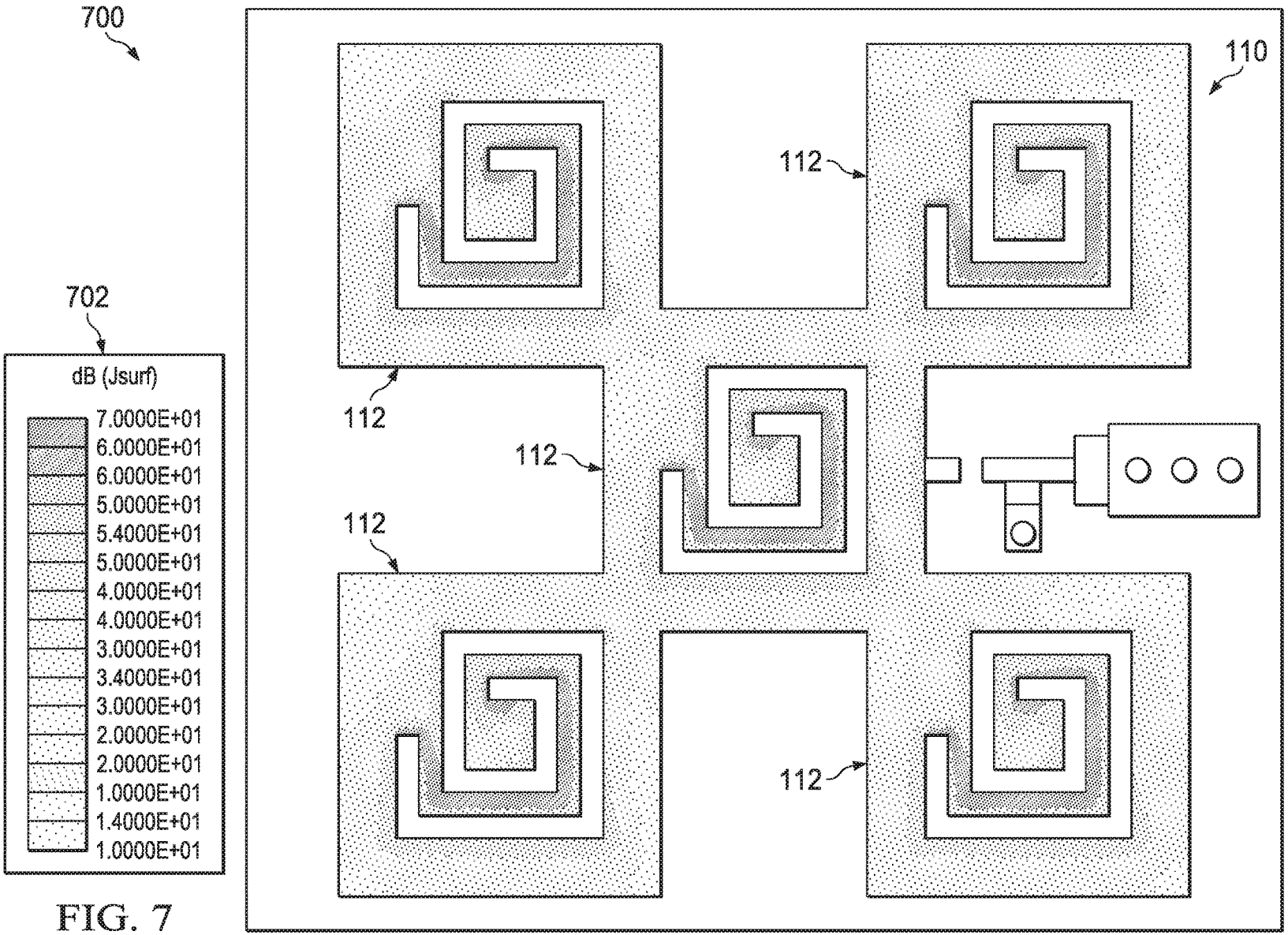
FIG. 7 is a diagram illustrating a current distribution in a radiating plane of the duplicate-cell antenna of FIG. 1 in accordance with some embodiments.

FIG. 7 illustrates a top view of a simulated current distribution in the radiating plane 110 of the implementation of the duplicate-cell antenna 100 of FIG. 1. The parameters of the simulation that produced the represented current distribution are: 2.4 GHz simulation frequency, and excitation: lump port and 1 watt (W) incident power. As represented by key 702, the depth of shading present in the conductive material of the radiating plane 110 represents the current flow in that same area in this simulation. Thus, as demonstrated by the illustrated simulation results, the current distribution between corresponding areas of each unit cell 112 is substantially uniform from unit cell to unit cell, thus indicating that all five unit cells 112 resonate substantially equally and at the substantially same phase. This in turn means that the resonance of the unit cells 112 combine together constructively, and thus the duplicate-cell antenna 100 is relatively efficient and effective.

Figure 8:
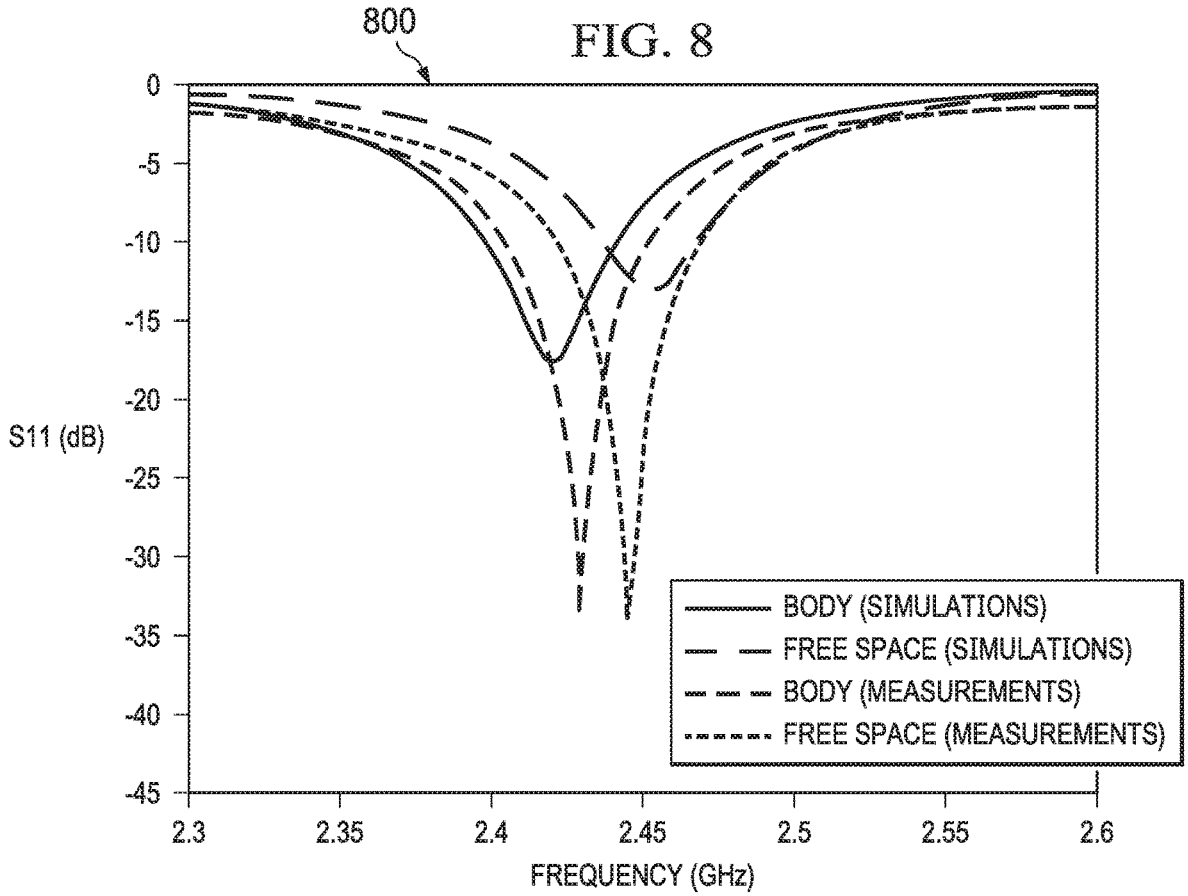
FIG. 8 is a chart illustrating measured and simulated return loss of the duplicate-cell antenna of FIG. 1 in accordance with some embodiments.

FIG. 8 illustrates a chart 800 illustrating the reflection coefficient (parameter S11)(also commonly referred to as "return loss") for an implementation of embodiment of the duplicate-cell antenna 100 of FIG. 1 at a microwave frequency band commonly used for cross-body wireless communications (2.3-2.6 GHz). Chart 800 illustrates both simulated and measured reflection coefficient results of the duplicate-cell antenna 100 for both a free-space test case and a cross-body test case. In particular, it is noted that in this implementation, the duplicate-cell antenna 100 exhibits an S11 parameter of at least −30 decibels at 2.45 GHz, demonstrating that the frequency detuning between on-body and free space is relatively small and a good match thus can be readily achieved.

Figure 9:
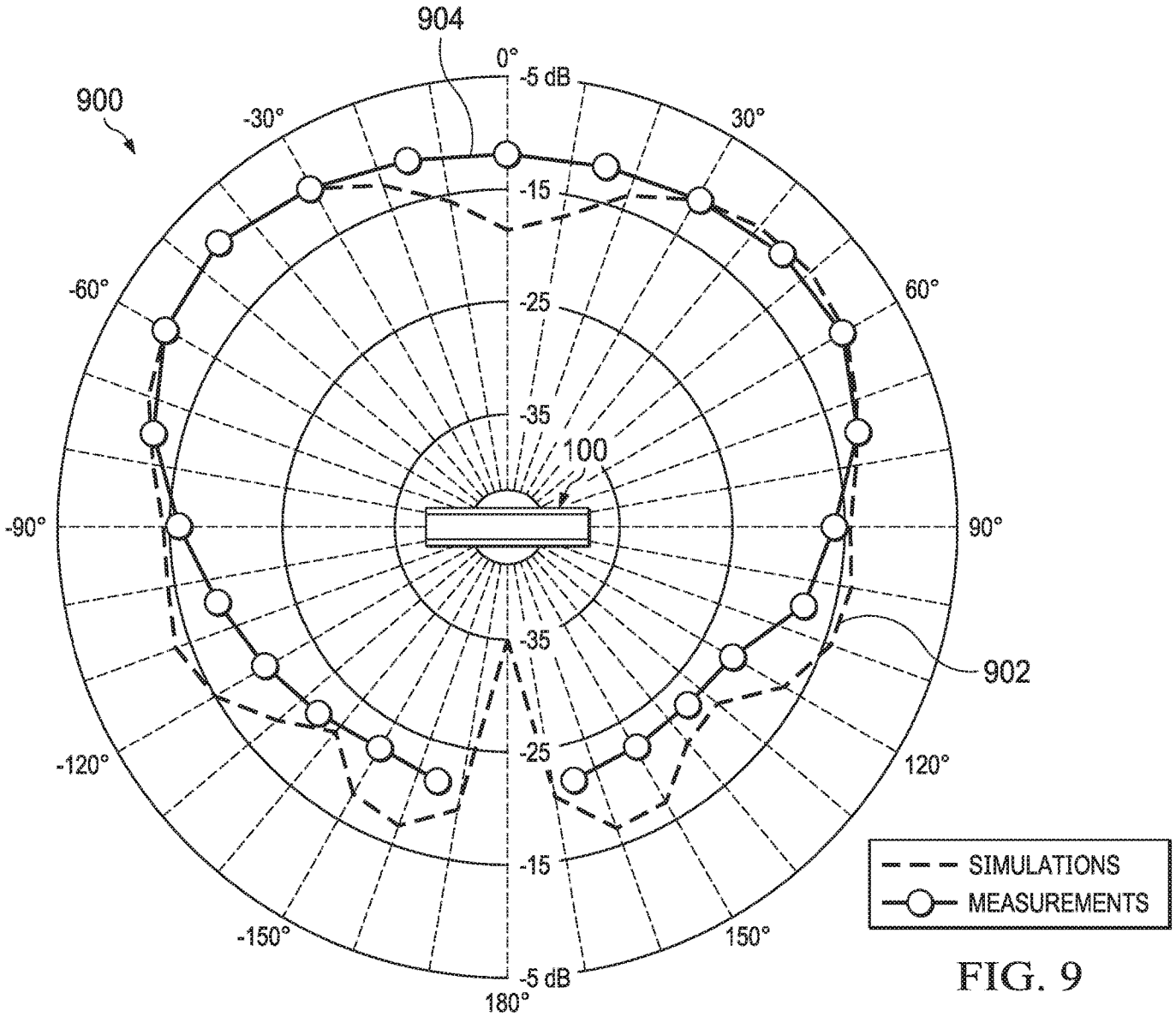
FIG. 9 is a chart illustrating a radiation pattern of the duplicate-cell antenna of FIG. 1 in accordance with some embodiments.

FIG. 9 illustrates a chart 900 illustrating both a simulated radiation pattern (line 902) and a measured radiation pattern (line 904) for an implementation of embodiment of the duplicate-cell antenna 100 of FIG. 1 at a 2.4 GHz center frequency in the orientation depicted in the chart 900. As illustrated by both radiation patterns, the duplicate-cell antenna 100 exhibits that the maximum radiation direction is near the interference of body and air (x-y) plane, and thus demonstrating that the efficacy of the duplicate-cell antenna 100 is relatively orientation independent and thus well-suited for implementation in body-wearable devices for cross-body communications.

Figure 10:
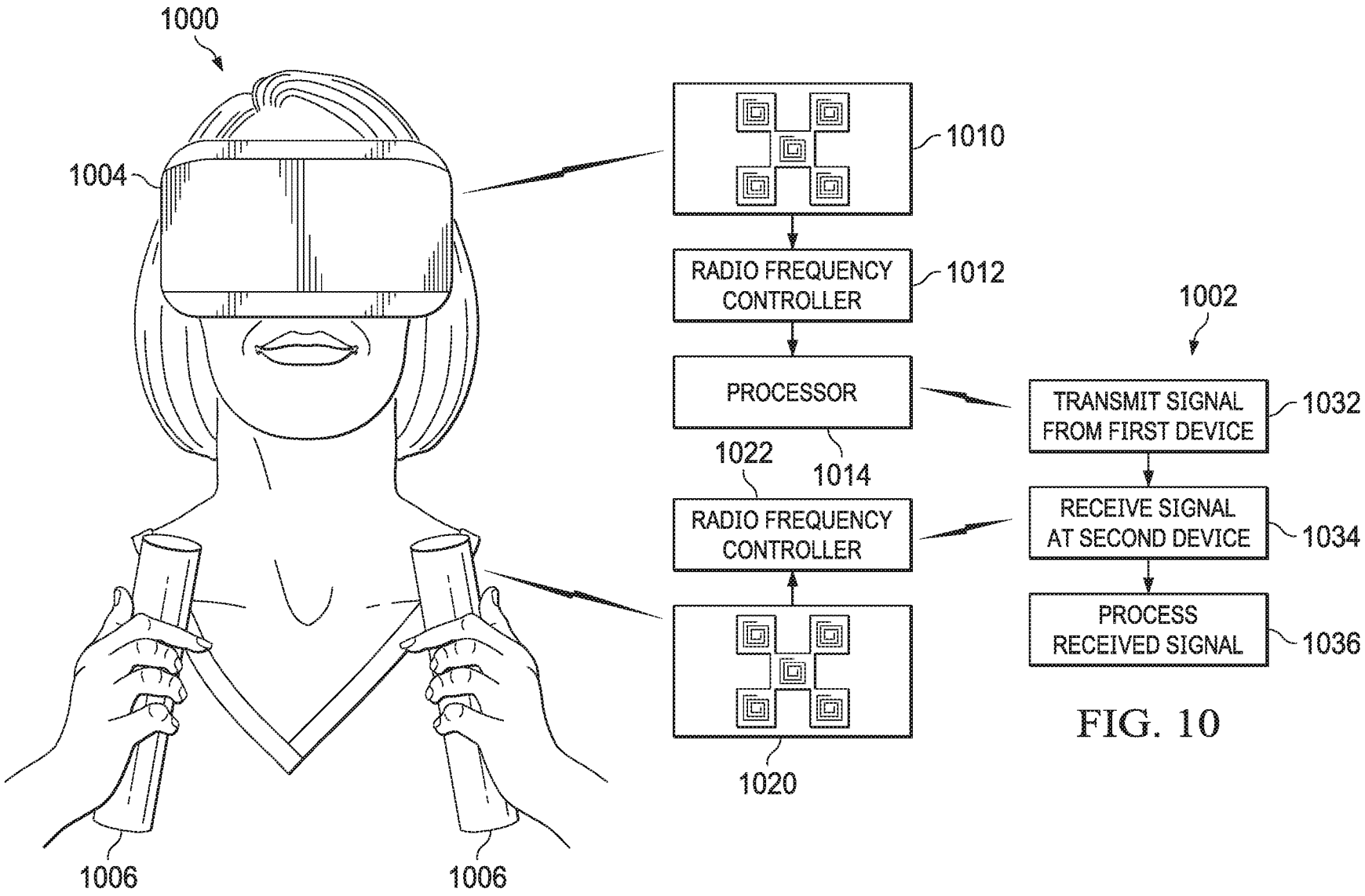
FIG. 10 is a diagram illustrating a wireless system employing duplicate-cell antennas and a method of its use in accordance with some embodiments.

FIG. 10 illustrates an example wearable-device system 1000 employing one or more instances of the duplicate-cell antenna 100 and a method 1002 for its use in accordance with at least some embodiments. In this example embodiment, the wearable-device system 1000 includes a head-mounted display (HMD) device 1004 mountable on a user's head and one or more handheld controllers 1006 held by the user or otherwise mounted in close proximity to the user's hands. The HMD device 1004 is configured to display virtual reality (VR) or augmented reality (AR) content to the user. In at least one embodiment, the VR or AR content is user-interactive, and in particular, uses the position of the user's hands as an input to control one or more aspects of the VR or AR content. To this end, the HMD device 1004 includes a duplicate-cell antenna 1010 (one embodiment of the duplicate-cell antenna 100) coupled to a RF controller circuit 1012, which in turn is coupled to a digital signal processor (DSP) or other compute component 1014 of the HMD device 1004. Likewise, each handheld controller 1006 includes a duplicate-cell antenna 1020 (one embodiment of the duplicate-cell antenna 100) coupled to a RF controller 1022.

The method 1002 illustrates the method of operation of the HMD device 1004 with respect to each of the handheld controllers 1006. At block 1032, the RF controller 1022 excites the duplicate cell antenna 1020 to radiate a wireless beacon at a microwave frequency. To illustrate, the RF controller 1022 may include a Bluetooth™-compatible controller that controls the duplicate cell antenna 1020 to emit a beacon at a center frequency of 2.4 GHz in accordance with a Bluetooth™ standard. At block 1034, the duplicate cell antenna 1010 of the HMD device 1004 receives the wireless signaling representing the wireless beacon and provides the received signal to the RF controller 1012. At block 1036, the RF controller 1012 processes the received signal and provides a representation of the received signal to the compute component 1014, which in turn process the received information to register a position of the handheld controller 1006 relative to the HMD device 1004, and then modify the presented AR/VR content or otherwise take some action responsive to this registered position of the handheld controller 1006.

In some embodiments, certain aspects of the techniques described above may implemented by one or more processors of a processing system executing software. The software comprises one or more sets of executable instructions stored or otherwise tangibly embodied on a non-transitory computer readable storage medium. The software can include the instructions and certain data that, when executed by the one or more processors, manipulate the one or more processors to perform one or more aspects of the techniques described above. The non-transitory computer readable storage medium can include, for example, a magnetic or optical disk storage device, solid state storage devices such as Flash memory, a cache, random access memory (RAM) or other non-volatile memory device or devices, and the like. The executable instructions stored on the non-transitory computer readable storage medium may be in source code, assembly language code, object code, or other instruction format that is interpreted or otherwise executable by one or more processors.

A computer readable storage medium may include any storage medium, or combination of storage media, accessible by a computer system during use to provide instructions and/or data to the computer system. Such storage media can include, but is not limited to, optical media (e.g., compact disc (CD), digital versatile disc (DVD), Blu-Ray disc), magnetic media (e.g., floppy disc, magnetic tape, or magnetic hard drive), volatile memory (e.g., random access memory (RAM) or cache), non-volatile memory (e.g., read-only memory (ROM) or Flash memory), or microelectromechanical systems (MEMS)-based storage media. The computer readable storage medium may be embedded in the computing system (e.g., system RAM or ROM), fixedly attached to the computing system (e.g., a magnetic hard drive), removably attached to the computing system (e.g., an optical disc or Universal Serial Bus (USB)-based Flash memory), or coupled to the computer system via a wired or wireless network (e.g., network accessible storage (NAS)).

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. An antenna comprising:

a planar dielectric substrate having opposing first and second surfaces;

a ground plane disposed at the first surface, the ground plane composed of conductive material; and a radiating plane disposed at the second surface and composed of conductive material, the radiating plane including a plurality of unit cells, wherein each unit cell comprises:

a corresponding section of the conductive material of the radiating plane that is formed in a specified shape, the specified shape including a first portion forming a load inductor and second portion forming a radiating patch electrically coupled to the load inductor and wherein the conductive material of the radiating plane of the unit cell is continuous with the conductive material of the radiating plane of at least one other unit cell of the plurality of unit cells; and at least one via electrically coupling the load inductor to the ground plane.

2. The antenna of claim 1, wherein at least part of the first portion is formed in the shape of a spiral.

3. The antenna of claim 2, wherein the at least one via includes a via electrically coupling a center of the spiral.

4. The antenna of claim 1, wherein the second portion comprises conductive material that at least partially surrounds the first portion.

5. The antenna of claim 1, wherein the second portion comprises conductive material that completely surrounds the first portion.

6. The antenna of claim 1, wherein the specified shape has a rectangular perimeter.

7. The antenna of claim 1, wherein the unit cells are arranged in an X pattern on the second surface.

8. The antenna of claim 1, wherein the unit cells are arranged in an H pattern on the second surface.

9. The antenna of claim 1, wherein the unit cells are arranged in a C pattern on the second surface.

10. The antenna of claim 1, wherein the radiating plane is configured to operate at a center frequency of approximately 2.4 gigahertz (GHz).

11. The antenna of claim 10, wherein the radiating plane has a reflection coefficient (S11) of at least −30 decibels at 2.45 GHz.

12. A wearable device comprising the antenna of claim 1, the wearable device further comprising:

a processor; and a radio frequency (RF) controller coupled to the processor and to the antenna.

13. An antenna comprising:

a planar dielectric substrate having opposing first and second surfaces;

a ground plane disposed at the first surface, the ground plane composed of conductive material; and a radiating plane disposed at the second surface, the radiating plane including a plurality of unit cells, wherein each unit cell comprises:

a layer of conductive material formed at the second surface in a specified shape, the specified shape forming a radiating patch having an opening substantially devoid of the conductive material;

at least one via extending from the opening to the ground plane; and a discrete inductor disposed at the second surface and electrically coupling the at least one via to the conductive material of the radiating patch.

14. The antenna of claim 13, wherein the specified shape has a rectangular perimeter.

15. The antenna of claim 13, wherein the unit cells are arranged in an X pattern on the second surface.

16. The antenna of claim 13, wherein the unit cells are arranged in an H pattern on the second surface.

17. The antenna of claim 13, wherein the unit cells are arranged in a C pattern on the second surface.

18. The antenna of claim 13, wherein the radiating plane is configured to operate at a center frequency of approximately 2.4 gigahertz (GHz).

19. The antenna of claim 18, wherein the radiating plane has a reflection coefficient (S11) of at least −30 decibels at 2.45 GHz.

20. The antenna of claim 13, wherein the substrate comprises a flexible substrate.

21. A wearable device comprising the antenna of claim 13, the wearable device further comprising:

a processor; and a radio frequency (RF) controller coupled to the processor and to the antenna.

22. A method comprising:

transmitting a radio frequency (RF) signal from a first antenna of a first device mounted at a first location on a user's body to a second antenna of a second device mounted at a second location on the user's body; and wherein at least one of the first antenna and the second antenna comprises:

a planar dielectric substrate having opposing first and second surfaces;

a ground plane disposed at the first surface, the ground plane composed of conductive material; and a radiating plane disposed at the second surface, the radiating plane including a plurality of unit cells, wherein each unit cell comprises:

a layer of conductive material formed at the second surface in a specified shape, the specified shape including a first portion forming a load inductor and second portion forming a radiating patch electrically coupled to the load inductor and wherein the conductive material of the radiating plane of the unit cell is continuous with the conductive material of the radiating plane of at least one other unit cell of the plurality of unit cells; and at least one via electrically coupling the load inductor to the ground plane.

23. The method of claim 22, wherein:

the first device comprises a head mounted display (HMD) device to display content representing at least one of virtual reality (VR) content or augmented reality (AR) content;

the second device comprises a handheld controller in wireless communication with the HMD device; and the method further comprises:

processing the RF signal to determine at least one of a position and orientation of the handheld controller relative to the HMD device.

* * * * *